US008051604B2

(12) United States Patent
Diekmann et al.

(10) Patent No.: US 8,051,604 B2
(45) Date of Patent: Nov. 8, 2011

(54) HINGE/TILT WINDOW DRIVEN BY AN ELECTRIC MOTOR AND COMPRISING A FEED CHAIN

(75) Inventors: Bernd Diekmann, Halle/Westf. (DE); Oliver Niemeier, Spenge (DE); Burkhard Wilker, Bielefeld (DE)

(73) Assignee: Schuco International KG, Bielefeld (DE)

( * ) Notice: Subject to any disclaimer, the term of this patent is extended or adjusted under 35 U.S.C. 154(b) by 966 days.

(21) Appl. No.: 11/814,076

(22) PCT Filed: Jan. 3, 2006

(86) PCT No.: PCT/EP2006/050015

§ 371 (c)(1),
(2), (4) Date: Jul. 18, 2007

(87) PCT Pub. No.: WO2006/074972

PCT Pub. Date: Jul. 20, 2006

(65) Prior Publication Data

US 2008/0040978 A1 Feb. 21, 2008

(30) Foreign Application Priority Data

Jan. 15, 2005 (DE) ..... 10 2005 001 985
Feb. 11, 2005 (DE) ..... 10 2005 006 313

(51) Int. Cl.
*E05D 15/52* (2006.01)

(52) U.S. Cl. ..... 49/192; 49/325

(58) Field of Classification Search ..... 49/192, 49/325; 52/200

See application file for complete search history.

(56) References Cited

U.S. PATENT DOCUMENTS

| | | | | | |
|---|---|---|---|---|---|
| 3,911,621 | A * | 10/1975 | McHeffey | 49/192 |
| 4,014,136 | A * | 3/1977 | Hemens et al. | 49/325 |
| 4,035,953 | A * | 7/1977 | Bierlich | 49/192 |
| 4,942,694 | A * | 7/1990 | Simoncelli | 49/192 |
| 5,052,079 | A * | 10/1991 | Vosskotter | 16/367 |
| 5,081,741 | A * | 1/1992 | Aumercier | 16/238 |
| 5,226,256 | A * | 7/1993 | Fries et al. | 49/13 |
| 5,802,768 | A * | 9/1998 | Hammer et al. | 49/325 |
| 2004/0128914 | A1 * | 7/2004 | Hempelmann | 49/192 |

FOREIGN PATENT DOCUMENTS

| | | | |
|---|---|---|---|
| DE | 2113665 | A1 | 10/1972 |
| DE | 10300654 | A1 | 7/2004 |
| EP | 0385414 | | 9/1990 |
| FR | 2581119 | A1 * | 10/1986 |
| GB | 1391723 | | 4/1975 |

* cited by examiner

*Primary Examiner* — Katherine Mitchell
*Assistant Examiner* — Catherine A Kelly
(74) *Attorney, Agent, or Firm* — Barnes & Thornburg LLP

(57) ABSTRACT

The invention relates to a hinge/tilt window with a window frame and a casement with a casement frame that can be tilted about a horizontal rotational axis (X) and about a vertical rotational axis in relation to the window frame. The window also includes a hinge/tilt shank for opening and closing the casement. The hinge/tilt shank has a main arm that is hinged on the casement frame for tilting the casement and a gear with multiple articulations that is hinged on the main arm and the window frame in order to rotate the casement about the vertical rotational axis. A drive device, which is driven by an electric motor, includes a feed chain for opening the casement into a tilted position and for closing the casement from the tilted position.

11 Claims, 4 Drawing Sheets

HINGE/TILT WINDOW DRIVEN BY AN ELECTRIC MOTOR AND COMPRISING A FEED CHAIN

CROSS-REFERENCE TO RELATED APPLICATIONS

This application is a National Phase Patent Application that relies for priority on PCT/EP2006/050015, filed on Jan. 3, 2006, which in turn relies for priority on German Patent Application No. 10 2005 001 985.4, filed on Jan. 15, 2005, and on German Patent Application No. 10 2005 006 313.6, which was filed on Feb. 11, 2005, the contents of all of which are incorporated herein by reference.

FIELD OF THE INVENTION

The invention relates to a hinge/tilt window including an electromotive drive having a feed chain.

DESCRIPTION OF THE RELATED ART

German Patent Document DE 103 00 654 A1 by the same applicant discloses a hinge/tilt window, which may be swung about a vertical axis of rotation. As should be appreciated from the disclosure, the window is also displaceable about a horizontal axis into a tilted position. This document shows a hinge/tilt window with an electromotive drive having an electric motor which acts by way of a gear upon a shear-resisting, shear-proof, or semi-shear-proof driving chain, also referred to as a feed chain. The electromotive drive automatically moves the window from the closed position into a tilted position. The chain is designed such that, during movement out of the chain case, it presses the casement in a shear-proof manner into its tilted position and, when the casement is closed, the chain is moved into the chain case. According to this document, the drives are placed on the casement or are milled at corresponding points into the groove of the casement frame.

Fittings, whose axes of rotation are situated outside the window frame and the casement frame and are defined by a hinge, are provided as fittings for the hinge/tilt function, as described in German Patent Document DE 103 00 654.

The partially pressure-resistant or pressure-resistant feed chains act either upon the main tilt-out arm of the hinge/tilt shank or, from the vertical groove, upon the shank hinge and, thereby, directly upon the pivot. In this case, the feed chain acts directly upon a fitting in the manner of a tilt-out device between the window frame and the casement or upon a hinge on the window frame and/or casement.

SUMMARY OF THE INVENTION

It is, therefore, one aspect of the invention to present hinge/tilt windows comprising an electromotive drive for implementing the tilting function in a simple manner.

The invention provides a hinge/tilt window having a window frame and a casement comprising a casement frame, which casement can be tilted about a horizontal axis of rotation as well as rotated about a vertical axis of rotation with respect to the window frame. The hinge/tilt window includes a hinge/tilt shank for opening and closing the casement, the hinge tilt shank having a main arm hinged to the casement frame for tilting the casement and a gear with multiple articulations which is hinged to the main arm and to the window frame in order to rotate the casement about the vertical axis of rotation. The hinge/tilt window further includes an electromotive drive device comprising a feed chain for opening the casement into its tilted position and for closing the casement from the tilted position. In a particularly preferred manner, the feed chain is applied to the main shank arm. Even more specifically, the feed chain is applied to the main shank arm in its end area facing the gear with multiple articulations.

The invention further develops the hinge/tilt window according to the above-mentioned type such that, also in the case of a rotational opening of the window, the drive does not have to be uncoupled from the hinge/tilt fitting or from the hinge/tilt shank. This construction is made possible at least in part because, starting with the closed position of the window, the drive securely locks the fitting during rotational opening of the window casement in the most simple manner at the casement and, thereby, virtually fixes the main arm during the rotation. Here, the use of the gear with multiple articulations for ensuring the rotational mobility about the vertical axis provides advantages.

In addition to hinge/tilt mountings with a defined pivot (axis point), as they are disclosed in German Patent Document DE 103 00 654, for example, hinge/tilt mountings are also known in the art which are arranged in a covered manner between the window frame and the casement frame. In this arrangement, the hinge/tilt mountings include gears with multiple articulations. In such cases, the casement is swiveled open in the rotational position. Such a multiple-articulation gear is disclosed, for example, in German Patent Document DE 21 13 665 C3. The above-described significant advantage of the locking of the window of the invention by using a multiple-articulation gear especially in combination with an electromotive drive comprising a feed chain is not described by the prior art. Additionally, by locating a feed chain in the end area of the main shank arm, especially in an area of at least the last 20% of the length of the window frame, it is not necessary to unlock the chain during rotation. At least for these reasons, among others, the invention improves upon the art and addresses failing in the art not previously addressed.

BRIEF DESCRIPTION OF THE DRAWINGS

In the following, the invention will be described in detail by means of embodiments with reference to the drawing.

DETAILED DESCRIPTION OF EMBODIMENT(S) OF THE INVENTION

Figure 1:
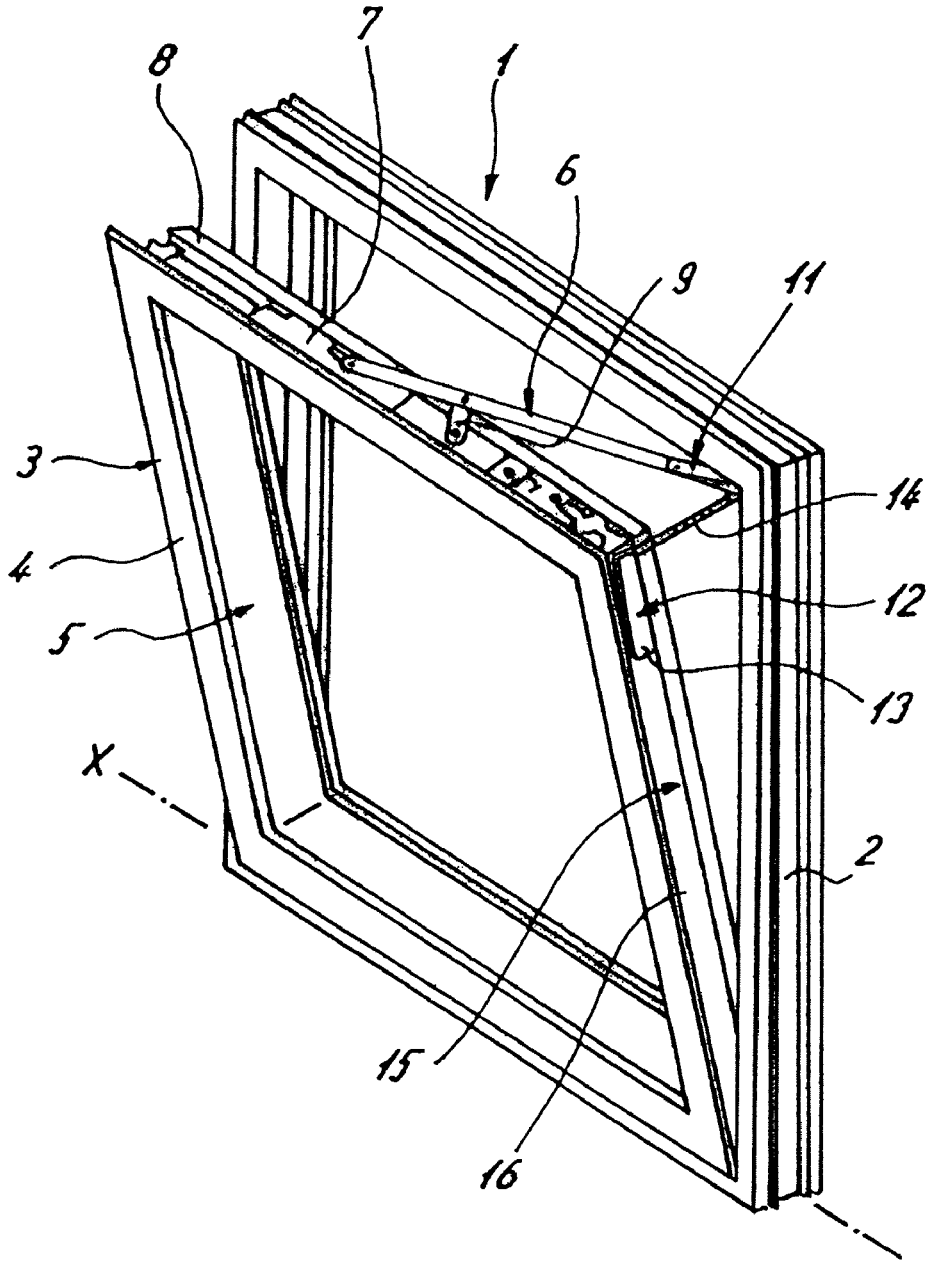
FIG. 1 is a perspective view of a hinge/tilt window having a hinge/tilt shank and an electromotive drive.

FIG. 1 illustrates a hinge/tilt window 1 having a window frame 2 and a casement 3 which may be swiveled about a horizontal axis of rotation X relative to the window frame 2 and may be rotated or tilted about a vertical axis of rotation. The vertical axis of rotation is disposed at a right angle to the horizontal axis of rotation. In addition, the hinge/tilt window 1 has a casement frame 4 into which a window pane 5 is inserted.

A hinge/tilt shank 6 is slidably held in a shank housing 7 at the upper casement frame wing 8 and is swivelably held by way of an additional arm 9.

Figure 3:
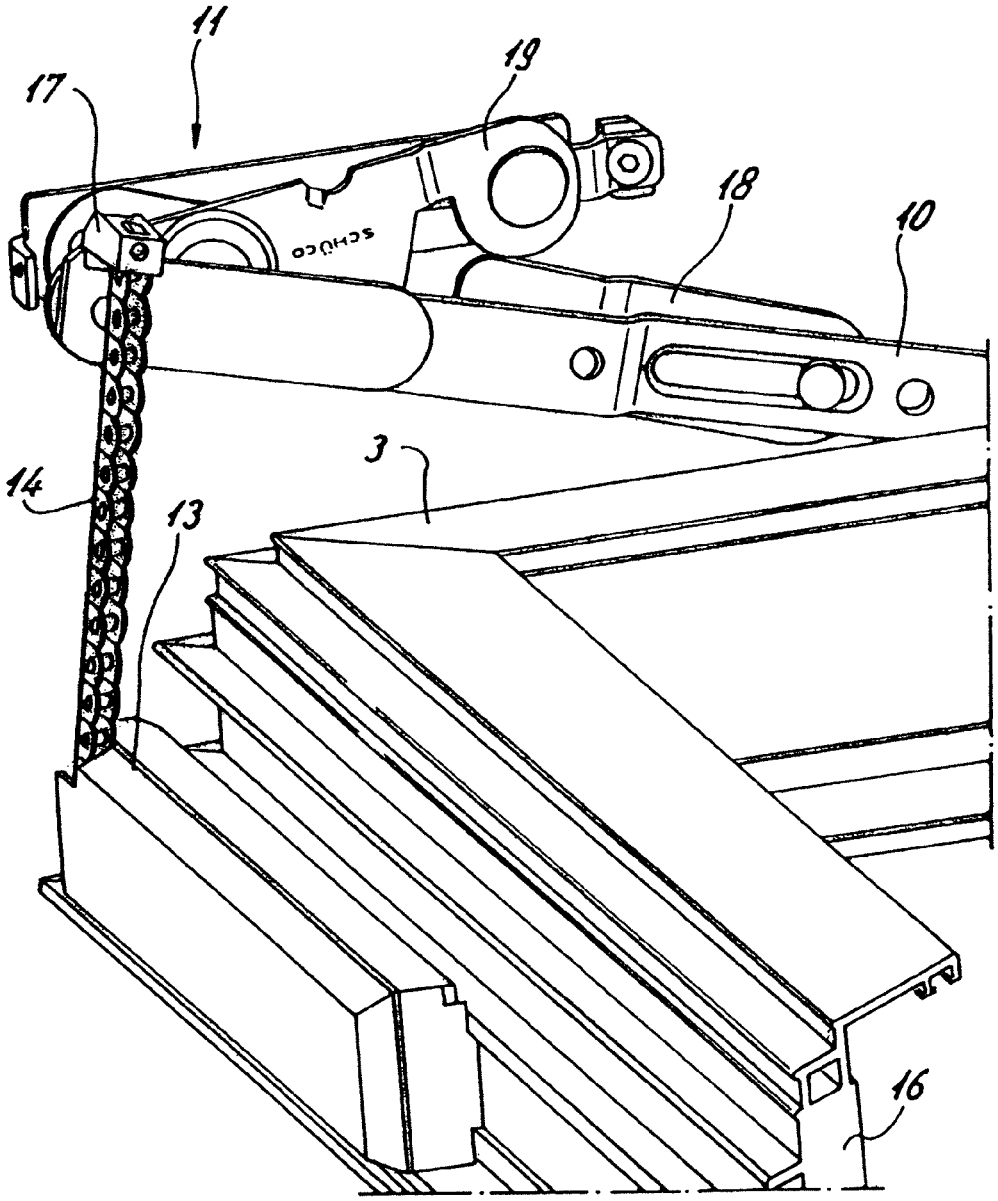
FIG. 3 is a view of the fitting as viewed from below, analogously to FIG. 2, the window being shown in a tilted position.

As shown in FIG. 3, for example, the hinge/tilt shank 6 has a main shank arm 10 for the tilted position. The main shank arm 10 extends between the window frame 2 (or a multiple-articulation gear arranged on the window frame 2) and the casement frame 4. The main shank arm 10 is swivelably guided on these two elements and is additionally displaceably guided on the casement frame 4.

In the illustrated embodiment, the main shank arm 10 is not fixed by way of a hinge fitting to the window frame 2, which is the case for the device described in German Patent Document DE 103 00654. Instead, a multiple-articulation gear 11 with several additional arms that can be rotated and/or displaced with respect to one another move the casement frame 4 relative to the window frame 2 into a rotational position about the vertical axis of rotation (see also FIG. 2).

In the embodiment where the multiple-articulation gear 11 is disposed in the window frame 2, a drive device is positioned at a corresponding point in the casement frame 4. The drive device 12 includes a drive housing 13 for an electric motor (not shown) and also includes a receiving space. The receiving space accommodates the feed chain 14 in the groove 15 of the vertical casement frame edge (or wing) 16 including the multiple-articulation gear 11. The shear-proof feed chain 14 is guided by the drive device 12 to the main shank arm 10 and, thereby, also to the multiple-articulation gear 11 of the hinge/tilt shank 6 or the tilt-out device.

Figure 2:
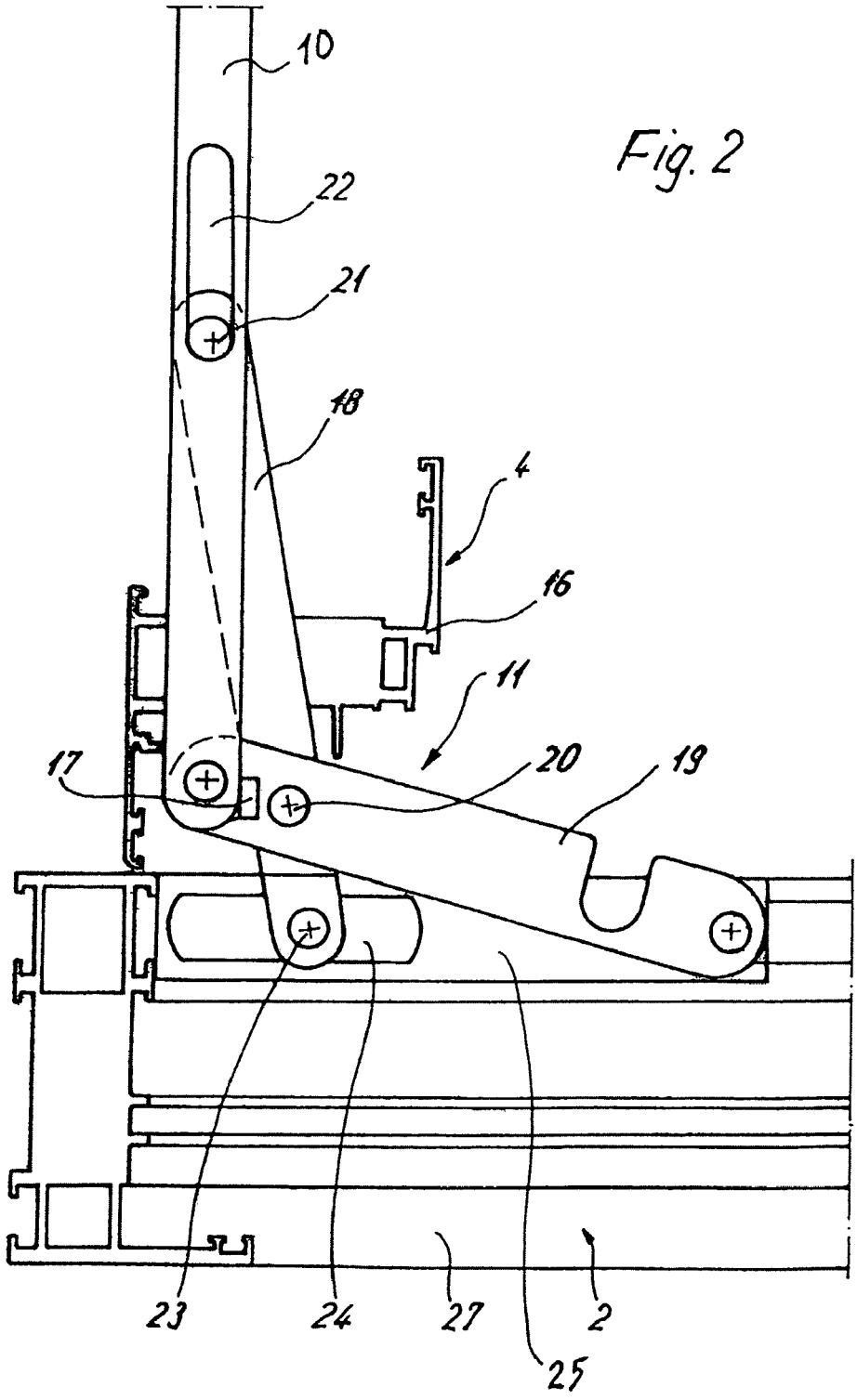
FIG. 2 is a view of the fitting of FIG. 1 from the, as viewed from the underside of the window.

FIGS 1-3 illustrate the main shank arm 10 of the hinge/tilt shank 6 with the multiple-articulation gear 11. In this illustration, the casement frame 4 has been rotated out relative to the window frame 2 into an opening position that is 90° relative to the closed position.

The hinge/tilt shank 6 is arranged at the top of the window, as shown in FIG. 1. As noted, FIG. 2 shows the fitting as viewed from beneath the window.

The main shank arm 10 rests against the upper horizontal casement frame spar 8 of the casement frame 4 with the additional arm 9 in a flat position.

A fastening tab 17 extends vertically with respect to the plane of the main shank arm 10 and is molded to the end of the main shank arm 10 in the direction of the multiple-articulation gear. The fastening tab 17 is fastened (for example, hooked) to the feed chain 14 in a simple manner at one end. In turn, the feed chain 14, which is disposed inside the window groove, is guided downward into the drive housing 13 of the drive device 12.

FIG. 2 also illustrates the construction of one embodiment of a multiple-articulation gear 11 for moving the casement 3 into its rotating position and its closed position.

The multiple-articulation gear has two gear arms 18, 19, which are rotatably connected to one another at a joint 20. At one of its ends, the gear arm 18 is displaceably guided by means of an attachment pin 21, which is disposed in a connecting link 22 of the main shank arm 10. At its opposite end, the gear arm 18 is guided by means of an attachment pin 23 in a connecting link 24 of a base plate 25. The base plate 25 is, in turn, fastened to the upper frame spar 27 of the window frame 2.

On a first side of a first end, the second gear arm 19 is connected by way of the joint 20 in an articulated manner with the first gear arm 18. A second side of the first end of the second gear arm 19 is hinged to the main shank arm 10 and a second end of the second gear arm 19 is hinged to the base plate 25 in such a manner that the casement 3 may be rotated in a restrictedly guided manner into the opened and closed positions.

FIG. 2 shows that, in the case of the multiple-articulation gear 11, the two gear arms 18, 19 change their position relative to the casement frame 4 and, thus, also with respect to the main shank arm 10 during the opening operation. The main shank arm 10 maintains its position with respect to the casement frame 4.

In the illustrated position in FIG. 2, the feed chain 14 secures the main shank arm 10 at the casement frame 4 by way of the self-locking drive. This position also does not change after closing the casement via the multiple-articulation gear 11.

FIG. 3 also shows the fitting from below, analogous to FIG. 2, but here the casement frame 4 is in its tilted position.

The casement frame 4 is shown as well as the drive device 12 with the drive housing 13. From the drive housing 13, the feed chain 14 is guided to the fastening tab 17 of the main shank arm 10. By means of the swiveling motion of the additional arm 9, the position of the fastening tab 17 remains approximately perpendicular to the window plane. Accordingly, the feed chain 14 also is set approximately perpendicular to the window plane, when the casement frame 4 is in the tilted opening position.

Figure 4:
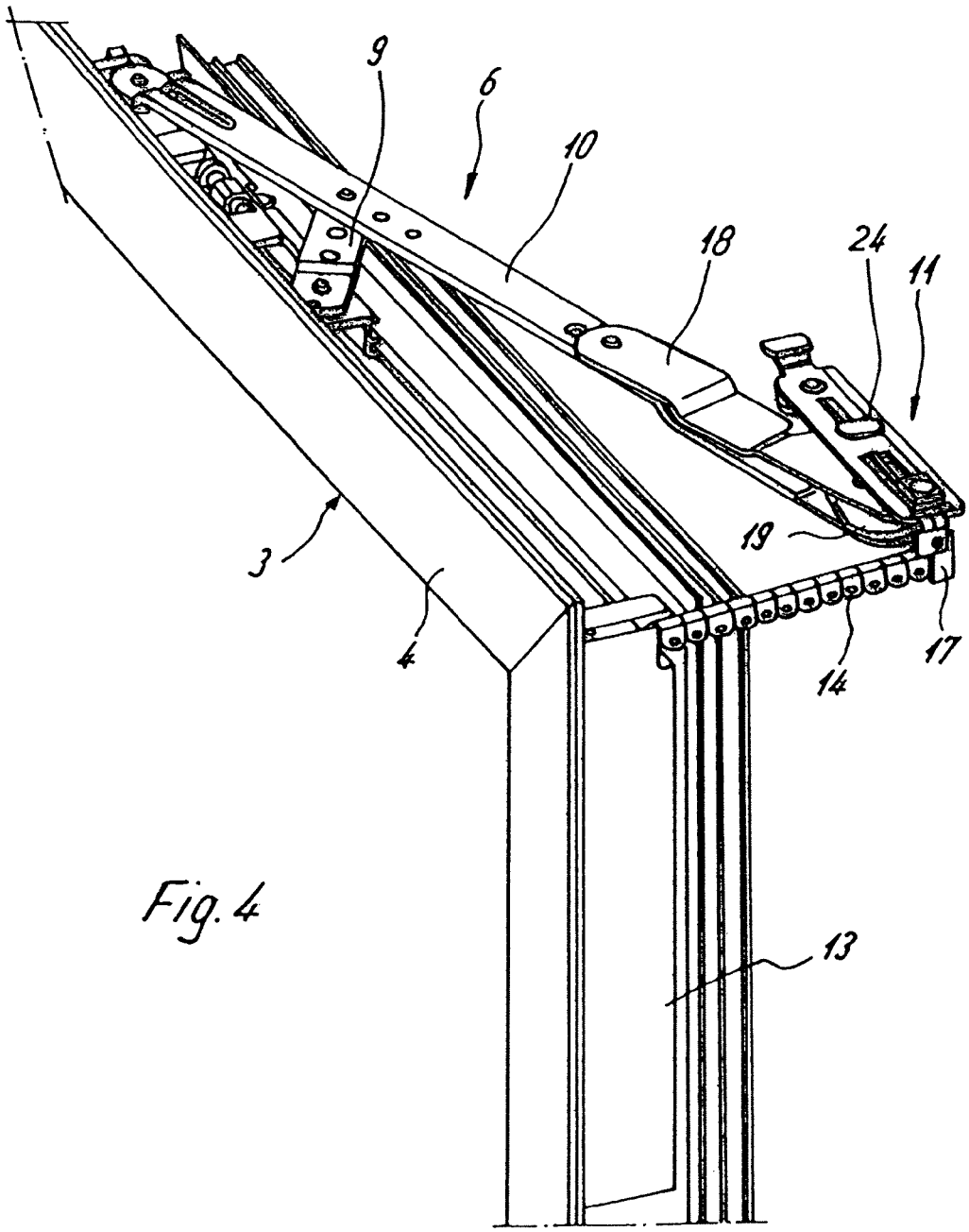
FIG. 4 is a view of a portion of the casement frame, which is oriented toward a multiple-articulation gear.

FIG. 4, in turn, shows the portion of the casement frame 4 which is oriented toward the multiple-articulation gear 11. The illustration of the window frame 2 is omitted here. This illustration shows the balancing effect of the additional arm 9, which, during the tilting movement moves the main shank arm 10 with respect to the casement frame 4 such that the fastening tab 17 describes an approximately vertical line with respect to the casement frame 4.

During the tilting operation, this vertical movement also takes place at any point along the main shank arm 10. This is utilized by the invention in that the feed chain 14 is maintained at the fitting with the tilt-out shank 6 and the multiple-articulation gear 11 in relation to the main shank arm 10.

The arrangement of the fastening tab 17 at the free end of the main shank arm 10 offers at least one advantage in that the drive device may be housed in the upper vertical area of the casement 3. One reason that this is advantageous is that sufficient space does not exist in the upper horizontal area of the casement 3, because the actual fitting or the tilt-out device is located in this position.

One further advantage of the invention lies in the placement of the drive device 12 in the groove between the window frame 2 and the casement frame 4. Since this construction avoids the need for recesses in the casement frame 4, additional machining may be avoided.

The invention claimed is:

1. A window, comprising:

a window frame;

a casement comprising a casement frame, wherein the casement defines a horizontal axis of rotation and a vertical axis of rotation, wherein the casement is tiltable about the horizontal axis of rotation and is pivotable about the vertical axis of rotation;

a shank for opening and closing the casement, wherein the shank comprises a main arm hinged to the casement frame permitting tilting of the casement about the horizontal axis of rotation;

a multiple-articulation gear with multiple articulations operable with the main arm and the window frame, permitting rotation of the casement about the vertical axis of rotation;

an electromotive drive comprising a feed chain wherein the electromotive drive permits tilting of the casement between opened and closed positions;

wherein the feed chain connects to the main arm at an end area of both the multiple-articulation gear and the main arm and an end area of the feed chain and the respective end areas of the multiple articulation gear and the main arm are located in an upper corner of the window frame; and wherein the electromotive drive comprises a drive housing located at the upper corner of a vertical casement frame edge in a groove between the window frame and the casement frame.

2. The window according to claim 1, further comprising:

a fastening tab disposed at one end of the main arm, wherein the feed chain is fastened thereto.

3. The window according to claim 2, wherein the fastening tab is oriented vertically with respect to the plane of the main arm.

4. The window according to claim 1, further comprising:

first and second gear arms, displaceable with respect to one another, wherein the main arm is fastened to the window frame via the multiple-articulation gear and the first and second gear arms.

5. The window according to claim 1, further comprising:

a shank housing disposed in an upper casement frame edge at one end of the shank; and an additional arm connected between the shank and the upper casement frame edge.

6. The window according to claim 1, wherein the drive housing accommodates an electric motor, a gear and the feed chain when the casement is closed.

7. The window according to claim 1, wherein the feed chain is guided by the electromotive drive in the groove.

8. The window according to claim 1, wherein the main arm is positioned parallel to the upper horizontal casement frame and the additional arm when the casement is in at least one of the opened and closed positions.

9. The window according to claim 1, wherein the multiple-articulation gear and the shank are coordinated such that first and second gear arms move when the casement is opened relative thereto.

10. The window according to claim 5, wherein the additional arm moves the main arm with respect to the casement frame such that a fastening tab for the feed chain defines substantially a vertical line with respect to the casement frame when the casement frame is tilted about the horizontal axis of rotation.

11. The window according to claim 4, wherein the first and second gear arms are rotatably connected with one another at a joint, wherein the first gear arm is displaceably guided at one end via a first attachment pin in a first connecting link and at an opposite end a second attachment pin in a second connecting link and the second gear arm is connected via the joint in an articulated manner with the first gear arm on one end and, on an opposite end, is hinged to the base plate.

* * * * *